US011232692B2

(12) United States Patent
Pagan Torres

(10) Patent No.: US 11,232,692 B2
(45) Date of Patent: Jan. 25, 2022

(54) BABY HOOP

(71) Applicant: Beniamino Pagan Torres, Guayanilla, PR (US)

(72) Inventor: Beniamino Pagan Torres, Guayanilla, PR (US)

( * ) Notice: Subject to any disclaimer, the term of this patent is extended or adjusted under 35 U.S.C. 154(b) by 0 days.

(21) Appl. No.: 17/010,756

(22) Filed: Sep. 2, 2020

(65) Prior Publication Data

US 2021/0343131 A1 Nov. 4, 2021

Related U.S. Application Data

(60) Provisional application No. 63/019,613, filed on May 4, 2020.

(51) Int. Cl.
*G08B 21/02* (2006.01)

(52) U.S. Cl.
CPC ..... *G08B 21/0225* (2013.01); *G08B 21/0208* (2013.01); *G08B 21/0258* (2013.01); *G08B 21/0266* (2013.01); *G08B 21/0269* (2013.01); *G08B 21/0277* (2013.01); *G08B 21/0283* (2013.01); *G08B 21/0288* (2013.01); *G08B 21/0291* (2013.01); *G08B 21/0294* (2013.01)

(58) Field of Classification Search
CPC ..... G08B 21/0225; G08B 21/0208; G08B 21/0258; G08B 21/0266; G08B 21/0269; G08B 21/0277; G08B 21/0283; G08B 21/0288; G08B 21/0291; G08B 21/0294
See application file for complete search history.

(56) References Cited

U.S. PATENT DOCUMENTS

| | | | | |
|---|---|---|---|---|
| 6,218,945 | B1 * | 4/2001 | Taylor, Jr. | A61B 5/0002 340/539.1 |
| 7,482,935 | B2 * | 1/2009 | Lee | G08B 21/02 128/903 |
| 8,981,926 | B2 * | 3/2015 | Al-Ali | G08B 21/0211 340/539.12 |
| 9,652,975 | B1 * | 5/2017 | Riley | G08B 25/009 |
| 9,654,917 | B2 * | 5/2017 | Shaprio | G08B 21/0288 |
| 9,892,609 | B2 * | 2/2018 | Kim | G08B 21/0453 |
| 2003/0011478 | A1 * | 1/2003 | Rabanne | G08B 21/0269 340/573.4 |
| 2007/0194924 | A1 * | 8/2007 | Karr | G08B 21/0225 340/572.1 |
| 2007/0262862 | A1 * | 11/2007 | Barrett | G08B 13/1427 340/539.15 |
| 2008/0291044 | A1 * | 11/2008 | Chan | G08B 21/24 340/686.6 |
| 2011/0106437 | A1 * | 5/2011 | Husain | G08B 21/0236 701/408 |
| 2012/0225633 | A1 * | 9/2012 | Nichols | H04M 11/04 455/404.1 |
| 2013/0050244 | A1 * | 2/2013 | Kim | G08B 21/0227 345/589 |

(Continued)

*Primary Examiner* — Nay Tun
(74) *Attorney, Agent, or Firm* — University of Puerto Rico; Eugenio J. Torres-Oyola; Victor M. Rodriguez-Reyes

(57) ABSTRACT

A programmable electronic, analog or digital intelligent bracelet device consisting of one or more units thought out to aid in the prevention of infant deaths or injuries due to parents forgetting their children while in the car or while conducting other activities. Device may also be used to monitor patients with Alzheimer and other similar conditions.

5 Claims, 10 Drawing Sheets

(56) References Cited

U.S. PATENT DOCUMENTS

| | | | | |
|---|---|---|---|---|
| 2014/0125491 | A1* | 5/2014 | Park | A61B 5/7455 340/870.01 |
| 2015/0094544 | A1* | 4/2015 | Spolin | A61B 5/6831 600/301 |
| 2015/0332578 | A1* | 11/2015 | Borgne | B60N 2/002 340/667 |
| 2016/0035205 | A1* | 2/2016 | Messenger | G08B 21/0453 340/539.15 |
| 2016/0150362 | A1* | 5/2016 | Shaprio | H04W 4/023 340/539.13 |
| 2016/0335876 | A1* | 11/2016 | Verma | G08B 13/1427 |
| 2016/0379459 | A1* | 12/2016 | Trang | G08B 21/24 340/457 |
| 2017/0035367 | A1* | 2/2017 | Reich | A61B 5/746 |
| 2017/0245791 | A1* | 8/2017 | Workman | G16H 40/63 |
| 2018/0040229 | A1* | 2/2018 | Munusamy | G08B 27/006 |
| 2018/0188697 | A1* | 7/2018 | Urban | G08B 21/0288 |
| 2019/0209022 | A1* | 7/2019 | Sobol | A61B 5/7435 |
| 2020/0000395 | A1* | 1/2020 | Ganesan | G08B 21/0236 |
| 2020/0037904 | A1* | 2/2020 | Tegen | A61B 5/746 |

* cited by examiner

BABY HOOP

CROSS-REFERENCE TO RELATED APPLICATIONS

This application is new and claims no priority over other applications

BACKGROUND OF THE INVENTION

The objective of this system is to prevent the death or injury of infants' or children resulting from abandonment in cars and other emergency situations, such as abductions, by monitoring certain health conditions, immediate environmental conditions and proximity between PUD and IUD, and providing alerts to contacts within the infant's personal network, Good Samaritan Network and other first responders. Invention may also be used to monitor patients with Alzheimer and other similar conditions.

The invention consists of a programmable electronic, analog or digital intelligent bracelet device involving of one or more units thought out to aid in the prevention of infant deaths or injuries due to parents forgetting their children while in the car or while conducting other activities.

BRIEF SUMMARY OF THE INVENTION

The product consists of:

One Parental Unit Device (PUD) Bracelet that acts as a transmitter and receptor sending and receiving information by way of electronic, analog or digital, exchange.

One Infant Unit Device (IUD) Bracelet that acts as a transmitter and receptor sending and receiving information by way of electronic, analog or digital, exchange.

The IUD senses all programmed information and sends it to the PUD for the determined action.

The PUD is to be worn at the wrist. The IUD is to be affixed to an infant's ankle, wrist, cart seat, or pinned to infant's clothes. Both the PUD and the IUD are adjustable. The bracelet fastens very securely to avoid accidental detachment.

DETAILED DESCRIPTION OF THE INVENTION

Description of the figures stated above.

PUD and the IUD Focus on:

1. TIME—Monitors in real time. All timeframes of alerts and actions documented in Monitoring System.
2. DISTANCE—Monitors distances between PUD and IUD.
3. OXYGEN LEVELS—Oxygen Sensor built-in the IUD. IUD shares readings with PUD.
4. TEMPERATURE LEVELS—Temperature Sensor built-in the IUD. Shares readings with PUD.
5. EMERGENCY ALERTS—IUD alerts PUD. When Danger is acknowledged, the BABY-HOOP Monitoring System comes into action.
6. EMERGENCY ASSISTANCE PROTOCOLS (EAP)—Emergency procedures activated by the system.
7. DEDICATED BABY-HOOP Monitoring System complements 360 degree protection.
8. EVIDENCE COLLECTION—Stored by the Monitoring System.

Figure 1:
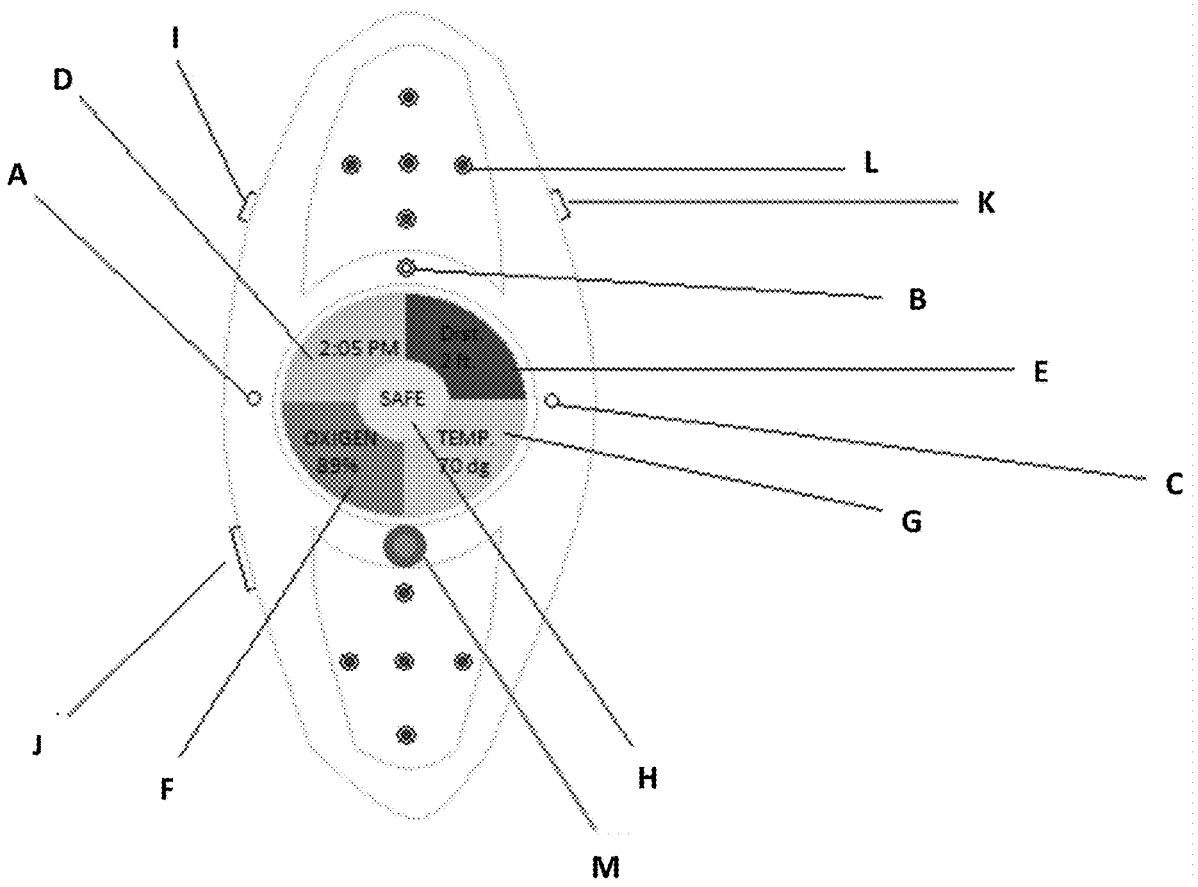
FIG. 1 is a top view perspective of the Parental Unit Device which comprises of a built-in microphone (A), a built-in camera (B), a built-in speaker (C), a display dial divided in 5 different sections including a time monitor display (D) on the top left corner, a distance monitor display (E) on the top right corner, an oxygen indicator (F) on the bottom left corner, the temperature monitor display (G) on the bottom right corner and a system idle display (H) in the center of the dial; The Parent Unit Device also comprises of an Alert Interrupt button (I), a programming and charging port (J), an On/Off button (K), a talk push-button right below the display dial and light alerts at the top and bottom of the display dial (L).
Figure 2:
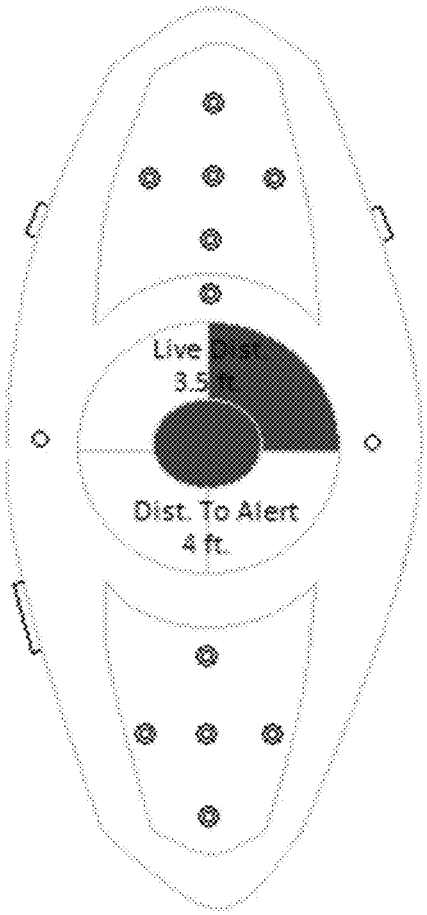
FIG. 2 is a top view perspective of the Parental Unit Device when a Distance Alarm is activated. A change to a predetermined color in the Idle display (N) indicates that the PUD and the IUD are about to go into alert mode. If further separation between the PUD and IUD continue the distance monitor display (E) will display actual distance between both units.
Figure 3:
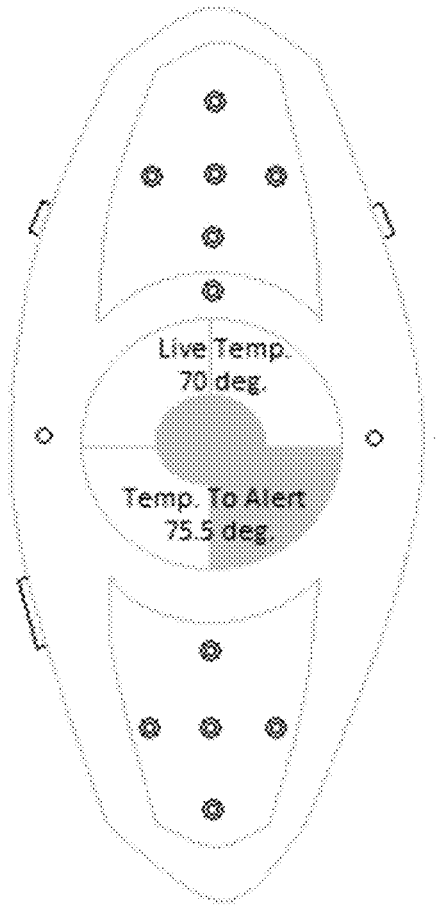
FIG. 3 is a top view perspective of the Parental Unit Device when temperature alarm is activated. A change to a predetermined color in the idle display indicates that the IUD is detecting minor changes in temperature. Once the temperature read by the IUD reaches the predetermined parameter, the temperature monitor (G) will display the temperature read by the IUD.
Figure 4:
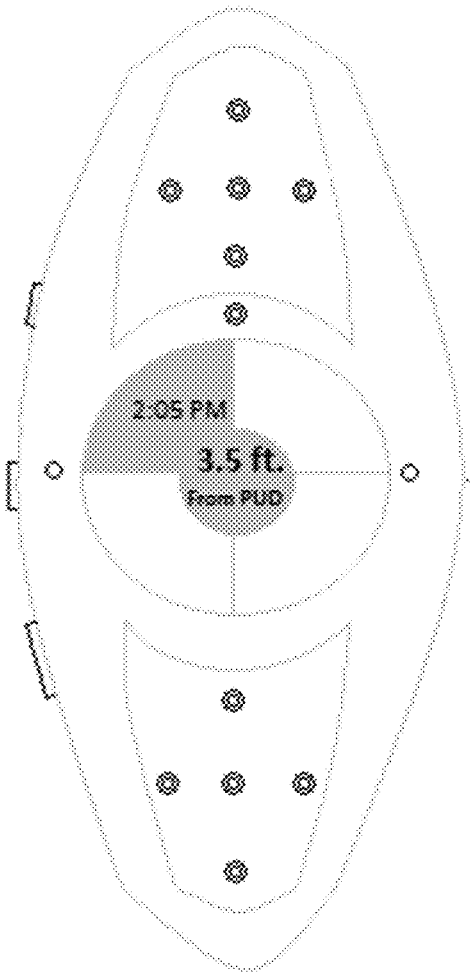
FIG. 4 is a top view perspective of the Parental Unit Device with the time display indicating time since separation from the IUD and the distance to the IUD.
Figure 5:
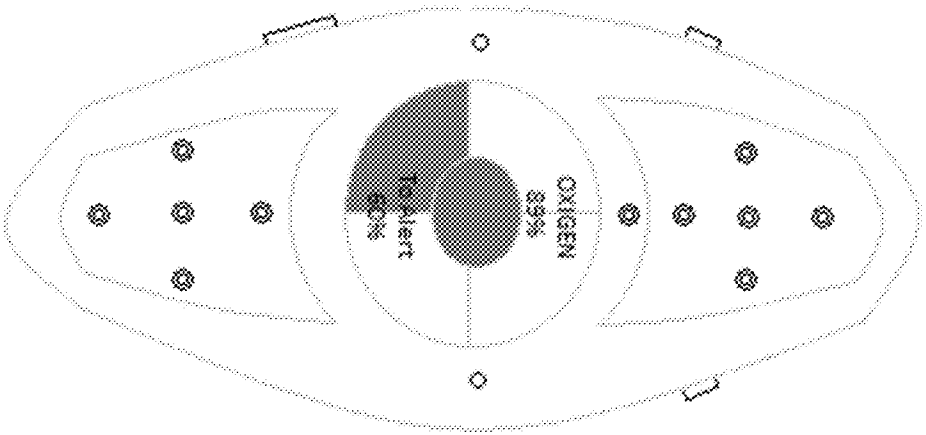
FIG. 5 is a top view perspective of the Parental Unit Device when oxygen alarm is activated. A change to a predetermined color in the idle display (N) indicates that the IUD is detecting minor changes in oxygen levels. Once the oxygen level read by the IUD reaches the predetermined parameter, the oxygen monitor (F) will display the oxygen alarm.
Figure 6:
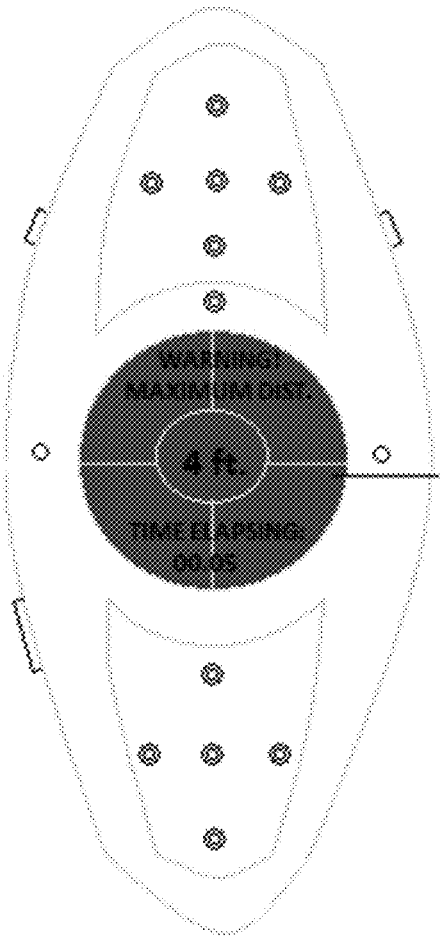
FIG. 6 is a top view perspective of the Parental Unit Device when the maximum time and distance alarm is activated. When the maximum time and distance predetermined parameter is reached the complete dial turns red and the emergency assistance protocol is activated.
Figure 7:
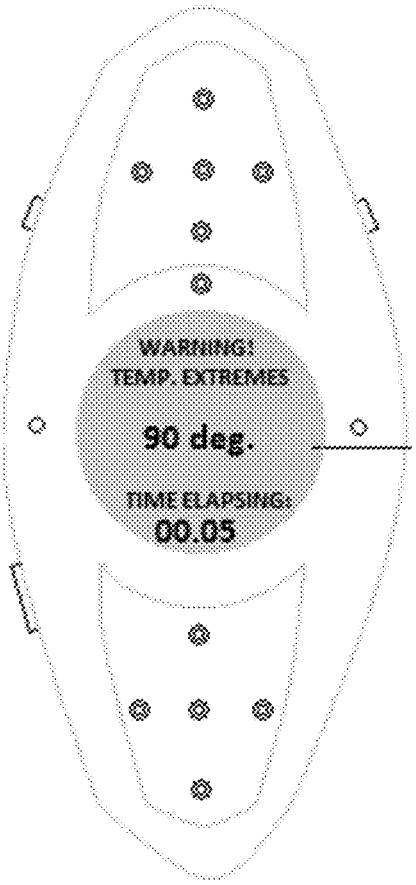
FIG. 7 is a top view perspective of the Parental Unit Device when the maximum temperature is reached. When the maximum temperature is reached the complete dial will display the temperature and the time elapsing. Once the temperature is about to turn dangerous the emergency assistance protocol is activated.
Figure 8:
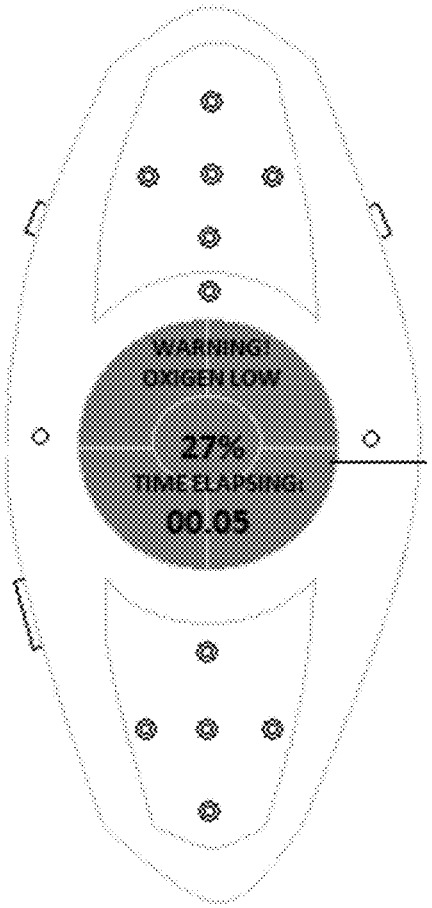
FIG. 8 is a top view perspective of the Parental Unit Device when the dangerous oxygen level is reached. When a dangerously low oxygen level is reached the complete dial will display the oxygen level and the time elapsing. The emergency assistance protocol is activated.
Figure 9:
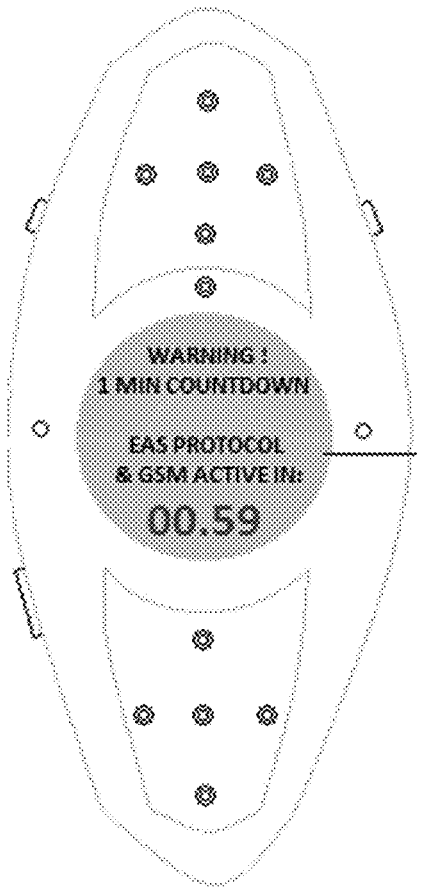
FIG. 9 is a top view perspective of the Parental Unit Device when the emergency assistance protocol is activated. The complete dial will indicate a countdown to activating the Good Samaritan Network. Once the preconfigured time has elapsed the vibration, lights and sounds will be activated in the IUD.
Figure 10:
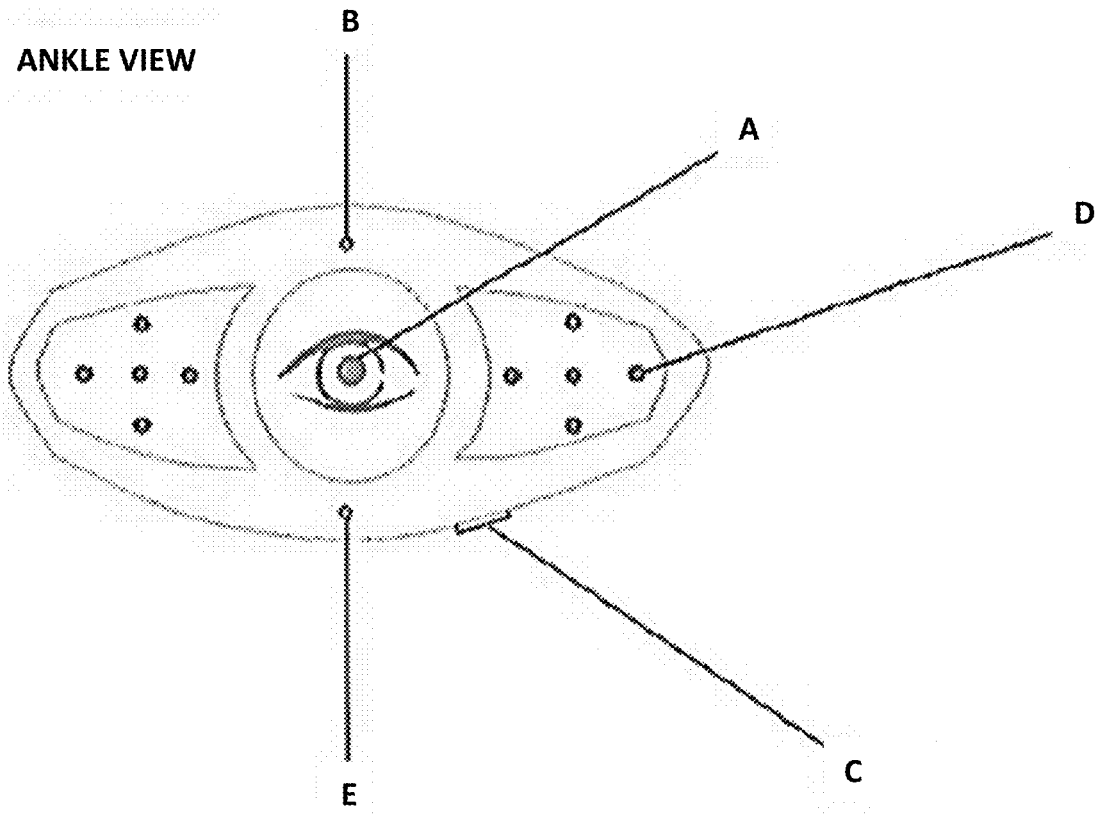
FIG. 10 is a top view perspective of the Infant Unit Device which comprises of a built-in camera (A), a built-in microphone (B), programming and charging cable port (C), lights alerts (D), built in speaker (E), built-in thermic sensor and a built-in oxygen sensor.

In an embodiment, a Parental Unit Device (PUD) shown in FIG. 1, comprised of a water resistant adjustable bracelet that acts as transmitter/receiver sending and receiving information by way of electronic, analog and digital information exchange. The PUD is equipped with a built-in readable digital screen similar to that of a smart watch. In the digital screen, the PUD displays light alerts that change in color patterns according to a specific alarm as shown in FIGS. 2 thru 9. The PUD is equipped with a build-in speaker that will activate automatically given the specific emergency signal transmitted by the IUD (FIG. 1, item c). The PUD is also equipped with a built-in microphone that becomes active at the press of a button at the parent unit. The infant may listen to parent's voice through the IUD speaker (FIG. 10—item E). The PUD vibrates, emits sounds and lights alerts as the IUD transmits notable changes in data such as distance, oxygen levels and temperature changes. The devices will connect each other through Bluetooth and will use location information via GPS technology. PUD's are powered by a long-lasting rechargeable battery similar to that of smart watches. PUD may be solar powered.

In another embodiment, an Infant Unit Device (IUD), in the form of a bracelet, comprising: a programmable water resistant adjustable bracelet that acts as transmitter/receptor sending/receiving information by way of electronic, analog or digital information exchange; built-in-camera, activating and recording all occurrences as soon as an emergency is picked up by the IUD system; built-in sensors, as shown in FIG. 10, capable of detecting and calculating distance between IUD and PUD, signaling the PUD or mobile device (including smart watch through special dedicated Monitoring System) through text or a combination of vibrating, lights and sound alerts (FIG. 10—Item D) as a certain predetermined distance is detected; a built-in thermic sensor, as shown in FIG. F, capable of measuring temperature in the immediate surroundings relative to the infant's location, able to project thermal activity on the PUD's or mobile's device digital screen, and alert the PUD and/or mobile device in the same manner described above, when dangerous temperature levels are reached; built-in oxygen sensor, as shown in FIG. G, capable of detecting oxygen levels and projecting them on the PUD's or mobile device's digital screen, automatically alerting in the same manner described above, once the IUD senses unsafe oxygenation level changes; equipped with a pulsating (visual) light alarm, as shown in FIG. 10—item A, able to self-project "light patterns" that call for visual attention of by passers or Good Samaritans registered in the dedicated Monitoring System, IUD light emergency alerts are enhanced by small magnifying transparent plastic/glass covers that highlight, intensify and direct the lights and beams in different directions so that their reflection travels farther outside the vehicle through its window glass in order to call the attention of potential Good Samaritans; built-in microphone and speaker, as shown in FIG. 10—item B and E respectively, automatically activated upon reaching n emergency condition or upon voluntary PUD or mobile device (including smart watch) voice communication. While in this mode, every time infant speaks or makes sound the IUD microphone will transmit to the PUD or mobile device built in speaker in a "walkie-talkie-like fashion"; Bluetooth and GPS capabilities. PUD's are powered by a long-lasting rechargeable battery similar to that of smart watches. PUD may be solar powered.

In another embodiment providing a method establishing an infant or child mobile proximity detection system (inside or outside a car) through an alarm protocol, periodically determining whether proximity parameters remain within the safe distance; sending first alert to PUD and/or infant's first mobile device or first set of mobile devices, collectively "Parental Network" or "PN", through dedicated Monitoring System after safe distance has been breached and conditions remain as such for a pre-determined amount of time; sending second alert to PUD, and/or simultaneously sending second alert to Parental Network, and "Child's Personal Network" or "CPN" through dedicated Monitoring System after unsafe distance persists for a pre-determined amount of time, CPN comprising a pre-determined amount of alternate participating mobile devices; sending third alert to PUD, and/or simultaneously sending third alert to Parental Network, Child's Personal Network, and the Good Samaritan Network (GSN) through dedicated Monitoring System, after unsafe distance persists for a pre-determined amount of time, The "Good Samaritan Network" or "GSN" further comprising a system where mobile device users from some or all active mobile carriers, join the network on a volunteer basis to assist infants in danger near their geo-location and local first responders, (collectively "Good Samaritan Network users" or "GSN users"), where GSN users within a predetermined radius ("Reaction Zone") relative to the infant, will be alerted of infant's emergency condition, thus allowing GSN users to respond. The method further comprises: periodically measuring, under any conditions, temperature in the immediate surroundings of the infant or child, and activating temperature alarm protocol upon transmission of first proximity alert, thereby transmitting alert to the PUD's and applicable mobile devices' digital screen or otherwise, when certain temperature threshold has been exceeded. Method further comprises: periodically measuring, under any conditions, child's or infant's oxygenation levels, and activating oxygenation alarm protocol upon transmission of first proximity alert, thereby transmitting alert to the PUD's and applicable mobile devices' digital screen or otherwise, when certain oxygenation threshold has been exceeded. Both, temperature and oxygenation protocols, transmit information to PUD and applicable mobile devices or networks in accordance with applicable alert stages within the proximity detection protocol. The GSN Monitoring System can be preloaded in factory phones by major mobile handset manufacturer or downloaded by choice from any mobile user in a GSM Network. The GSN Monitoring System will provide users with vital information such as vehicle description and geo-location of vehicle that will allow for quick location of the infant in distress. During an Abduction Emergency, the BaBy-HOOP Monitoring System (when authorized) may be able to remotely post to participating billboards in main highways everywhere in the world where the emergency is activated. During an Abduction Emergency the BaBy-HOOP Monitoring System (when authorized) may be able to remotely post to all registered Good Samaritan's social media profiles and send the information as an emergency bulletin to participating news agencies. Emergency information will be shared in all Baby-Hoop Monitoring Systems, social networks, all partner networks, mobile phones with the Monitoring System installed. The BaBy-HOOP Monitoring System will also send massive notifications to all Good Samaritans located in the approximate area where the GPS system places the infant. Upon receiving the emergency notification, Good Samaritans responding to the emergency will see an icon that reads "Good Samaritan Responding". Once pressed the Monitoring System will know the identity of the Good Samaritan that is or are responding to the situation.

All alarms picked up by the PUD and all IUD sensor readings will be recorded, documented and stored in the dedicated Monitoring System (this includes all oxygen, temperature, distance changes, along with time and date of all these events. As oxygen levels, temperature levels and distance details start to change they will all begin to be documented minute by minute.

The Monitoring System will pinpoint the approximate infant's location through its GPS system. Good Samaritans with the Monitoring System installed will have access to vehicle information that will only be displayed within the Monitoring System to registered Good Samaritans. Vehicle information will only be shared to Good Samaritans in an emergency. Vehicle information (Tag, make, color year etc.) will be provided voluntarily and in advance by parent through the dedicated Monitoring System once product is purchased and product setup has been completed. In the setup information, the parent must have documented emergency contact numbers and relative's contact numbers as well as employer contact and all pertinent details prompted by the Monitoring System.

Alarm Protocol may include the following:

YELLOW ALERT—SYSTEM IDLE—INFANT SAFE (When idle a yellow alert will display intermittently) When the system is idle and infant is considered "safe" PUD screen will maintain a yellow background meaning that it is in a normal non-emergency state. All other readings will also be visible intermittently or in full screen depending on the settings chosen by user.

RED ALERT—DISTANCE ALERT—"INFANT IN DANGER"—PUD will vibrate. Spoken message/beep will play. PUD is capable of calculating determined distances when away from the IUD and vice versa. Vibrating, audible and visual alerts will activate progressively as the IUD detects non-safe distance from the PUD. (If PUD is not able to read or display any of the alerts on its screen for any reason, parent can immediately access the dedicated Monitoring System and find all information there). Red background will show during this alert.

GREEN ALERT—TEMPERATURE ALERT—PUD will vibrate. Spoken message/beep will play. PUD is capable of projecting on its digital screen the temperature levels sensed by the built-in thermo sensor in the IUD. A special alert is activated by the IUD and then sent to the PUD when dangerous temperature levels are considered a threat to the safety of the infant. A green background can be seen during this alert.

BLUE ALERT—OXYGEN ALERT—PUD will vibrate. Spoken message/beep will play. PUD receives all data transmitted by the IUD. Oxygen fluctuations in the IUD are visible in the PUD screen. A special alert is activated by the IUD and then sent to the PUD when dangerous oxygen levels are considered a threat to the safety of the infant. Alerts can be interrupted by Parent by pressing a specific button on the PUD repeatedly; nevertheless, the PUD will begin alerting again every 30 seconds until PUD and IUD are within the programmed distance from each other. All alerts will be registered in the Baby-HOOP Monitoring System.

The Monitoring System will pinpoint the approximate infant's location through its GPS system. Good Samaritans with the Monitoring System installed will have access to vehicle information that will only be displayed within the Monitoring System to registered Good Samaritans. Vehicle information will only be shared to Good Samaritans in an emergency.

Vehicle information (Tag, make, color year etc.) will be provided voluntarily and in advance by parent through the dedicated Monitoring System once product is purchased and product setup has been completed. In the setup information, the parent must have documented emergency contact numbers and relative's contact numbers as well as employer contact and all pertinent details prompted by the by the Monitoring System.

The invention claimed is:

1. A system for providing alerts when a child is in danger, comprising: a parental unit device ("PUD") in the form of a bracelet comprising a transmitter, a receiver, a processor, a non-transitory memory, a speaker, a microphone, a display screen, and a global positioning system ("GPS") configured to receive global navigation satellite system signals; an infant unit device ("IUD") in the form of a bracelet comprising a transmitter, a receiver, a processor, a non-transitory memory, a thermal sensor, an oxygen sensor, camera, a speaker, a microphone, a display screen, and a GPS configured to receive global navigation satellite system signals;

wherein the non-transitory memory in the IUD comprises program instructions stored thereon, which when executed by a processor cause the IUD to perform the following steps:

detecting, via GPS, the distance between the IUD and the PUD;

signaling an alert, via the transmitter of the IUD, to the PUD in response to the distance exceeding a predetermined distance representing a safe distance;

detecting temperature via the thermal sensor of the IUD;

signaling an alert, via the transmitter of the IUD, to the PUD in response to the temperature exceeding a predetermined temperature representing a safe temperature;

detecting oxygen levels via the oxygen sensor of the IUD;

signaling an alert, via the transmitter of the IUD, to the PUD in response to the oxygen levels exceeding a predetermined oxygen threshold representing safe oxygen levels;

projecting a visual alert, via the display screen of the IUD, to call for visual attention of onlookers in response to: i) the distance exceeding a predetermined distance representing a safe distance, ii) the temperature exceeding a predetermined temperature representing a safe temperature, and iii) the oxygen levels exceeding a predetermined oxygen threshold representing safe oxygen levels;

emitting an auditory alert, via the speaker of the IUD, to call for visual attention of onlookers in response to: i) the distance exceeding a predetermined distance representing a safe distance, ii) the temperature exceeding a predetermined temperature representing a safe temperature, and iii) the oxygen levels exceeding a predetermined oxygen threshold representing safe oxygen levels;

displaying on the display screen of the PUD the corresponding alert signaled by the IUD; and signaling an alert to a dedicated monitoring system of good Samaritans near the geo-location of the IUD in response to: i) the distance exceeding a predetermined distance representing a safe distance, ii) the temperature exceeding a predetermined temperature representing a safe temperature, and iii) the oxygen levels exceeding a predetermined oxygen threshold representing safe oxygen levels.

2. The system of claim 1, wherein the speaker of the PUD emits a sound alert, and its display screen emits a yellow light to indicate a non-emergency state.

3. The system of claim 1, wherein the speaker of the PUD emits a sound alert, and its display screen emits a red light in response to the distance exceeding a predetermined distance representing a safe distance.

4. The system of claim 1, wherein the speaker of the PUD emits a sound alert, and its display screen emits a green light in response to the temperature exceeding a predetermined temperature representing a safe temperature.

5. The system of claim 1, wherein the speaker of the PUD emits a sound alert, and its display screen emits a blue light in response to the oxygen levels exceeding a predetermined oxygen threshold representing safe oxygen levels.

* * * * *